US010125735B2

(12) United States Patent
Mutlu

(10) Patent No.: US 10,125,735 B2
(45) Date of Patent: Nov. 13, 2018

(54) VALVE FOR CONTROLLING A FLUID WITH INCREASED SEALING ACTION

(71) Applicant: Robert Bosch GmbH, Stuttgart (DE)

(72) Inventor: Fatima Mutlu, Sindelfingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/772,445

(22) PCT Filed: Jan. 17, 2014

(86) PCT No.: PCT/EP2014/050886
§ 371 (c)(1),
(2) Date: Sep. 3, 2015

(87) PCT Pub. No.: WO2014/139706
PCT Pub. Date: Sep. 18, 2014

(65) Prior Publication Data

US 2016/0017855 A1 Jan. 21, 2016

(30) Foreign Application Priority Data

Mar. 11, 2013 (DE) ..... 10 2013 204 152

(51) Int. Cl.
*F02M 63/00* (2006.01)
*F02M 61/18* (2006.01)
*F02M 61/16* (2006.01)

(52) U.S. Cl.
CPC ..... *F02M 63/0077* (2013.01); *F02M 61/166* (2013.01); *F02M 61/1886* (2013.01); *F02M 63/0024* (2013.01)

(58) Field of Classification Search
CPC ..... F02M 61/10; F02M 61/12; F02M 61/04; F02M 63/0024; F02M 63/0077; F02M 61/166; F02M 61/1886
USPC ..... 239/533.11, 533.12, 585.1–585.5, 900
See application file for complete search history.

(56) References Cited

U.S. PATENT DOCUMENTS 2,874,000 A * 2/1959 Nystrom ..... F02M 61/08 239/453
3,279,704 A * 10/1966 Englehart et al. ... B63H 11/103 239/265.43
4,083,498 A * 4/1978 Cavanagh ..... F02M 61/18 239/533.11

(Continued)

FOREIGN PATENT DOCUMENTS

DE 102 46 230 4/2004
DE 102012205564 A1 10/2012

(Continued)

OTHER PUBLICATIONS

International Search Report for PCT/EP2014/050886, dated Apr. 9, 2014.

*Primary Examiner* — Christopher Kim
(74) *Attorney, Agent, or Firm* — Norton Rose Fulbright US LLP; Gerard Messina

(57) ABSTRACT

A valve for controlling a fluid, e.g., fuel, has a closing element and a valve seat. The valve seat has a sealing region and a valve seat region adjoining the sealing region. The closing element seals on the sealing region, the sealing region and the valve seat region merging with one another directly and without a step. A hardness of the sealing region is less than a hardness of the closing element.

6 Claims, 3 Drawing Sheets

(56) References Cited

U.S. PATENT DOCUMENTS

| | | | | |
|---|---|---|---|---|
| 2004/0129313 | A1 | 7/2004 | Aharonov et al. | |
| 2007/0228193 | A1* | 10/2007 | Kato | F02M 61/166 239/533.2 |
| 2010/0001215 | A1 | 1/2010 | Suzuki et al. | |

FOREIGN PATENT DOCUMENTS

| | | | |
|---|---|---|---|
| EP | 2025924 | A2 | 2/2009 |
| EP | 2 067 983 | | 6/2009 |
| JP | H06-175734 | A | 6/1994 |
| JP | H09-68134 | A | 3/1997 |
| JP | 2002155834 | A | 5/2002 |
| JP | 2003-214544 | A | 7/2003 |
| JP | 2004516410 | A | 6/2004 |
| JP | 2007177675 | A | 7/2007 |
| JP | 2007-247519 | A | 9/2007 |
| JP | 2007292057 | A | 11/2007 |
| JP | 2008-133752 | A | 6/2008 |
| JP | 2010-014088 | A | 1/2010 |
| JP | 2011001892 | A | 1/2011 |
| JP | 2012-172648 | A | 9/2012 |
| WO | WO 2004/040125 | | 5/2004 |

* cited by examiner

VALVE FOR CONTROLLING A FLUID WITH INCREASED SEALING ACTION

BACKGROUND OF THE INVENTION

1. Field of the Invention

The present invention relates to a valve for controlling a fluid, e.g., a fuel injection valve, having an increased tightness in the closed state of the valve.

2. Description of the Related Art

Valves for controlling fluids are known from the existing art, for example as injection valves. Here, a closing element opens, or closes, injection holes formed in a valve seat. The closing movement of the closing element here is a pushing movement. Here, when the valve is closed, i.e. when the closing element is situated on the valve seat, it is intended to be the case that no fuel escapes due to leakage, because in this way uncombusted fuel could flow into the exhaust gas system of an internal combustion engine. In addition, during operation of the valve the formation of particles, for example through abrasion, that could cause damage to the valve and/or to other components of an internal combustion engine is to be avoided. Because valves are standardly mass-produced components, a solution to this set of problems should be achieved in such a way that the valve has the greatest possible tightness while being suitable for mass production.

BRIEF SUMMARY OF THE INVENTION

The valve according to the present invention for controlling a fluid has the advantage that a tightness of the valve can be significantly improved. At the same time, the valve according to the present invention can easily be mass-produced at low cost. The valve according to the present invention has a particularly simple, low-cost, and easily produced design. According to the present invention, the valve has a closing element and a valve seat, the valve seat having a sealing region and a valve seat region adjoining the sealing region. The sealing element seals on the sealing region when the valve is in the closed state. In addition, the sealing region and the valve seat region merge directly and without transition; i.e., there is no step or interruption or the like between the sealing region and the valve seat region. In addition, a hardness of the sealing region is less than a hardness of the closing element. Through this measure, it is achieved in particular that in the closed state at most a minimum elastic deformation of the sealing region is achieved due to the harder closing element, so that an improved tightness is possible. In this way, an improved tightness can be achieved through the different hardnesses of the closing element and the sealing region.

Preferably, a difference in hardness between the sealing region and the closing element is selected such that when the valve closes no plastic deformation takes place. In this way, it can be ensured that, after a longer period of operation, the valve according to the present invention still has sufficient tightness, because no plastic deformations are present at the sealing region of the valve seat. During operation, an elastic deformation takes place at most in the closed state of the valve, but this deformation is immediately reversed when the closing element is lifted off of the sealing region. In other words, a plastic deformation of the sealing region by the closing element is prevented, so that the sealing properties of the valve are still adequately present even after a longer period of operation.

Particularly preferably, in the closed state of the valve a sealing line, in particular a circular sealing line, is present between the closing element and the sealing region. Further preferably, the closing element is a ball, and/or the valve seat is a ball surface.

According to a further preferred embodiment of the present invention, the valve seat region has a hardness that is greater than a hardness of the sealing region. Further preferably, a hardness of the valve seat region is also less than a hardness of the closing element. Due to the fact that the valve seat region is harder than the sealing region, it can be ensured that the necessary strength requirements on the valve seat are easily met.

According to a preferred embodiment of the present invention, the sealing region has an annular elastomeric sealing element situated in a groove in the valve seat. Preferably, a cross-section of the elastomeric sealing element is quadrangular, in particular rectangular. In this way, in particular a transition-free merging can be ensured between the sealing region and the valve seat region.

According to an alternative embodiment of the present invention, a material bond is formed between the sealing region and the valve seat region. In this way, in particular a one-piece valve seat can be provided. Particularly preferably, the valve seat here is a MIM component (metal powder injection molded component), and the sealing region and the valve seat region are produced from different materials.

Preferably, a guide region for guiding the closing element directly adjoins the sealing region, and the guide region has a hardness that is also less than a hardness of the closing element. Particularly preferably, the hardnesses of the guide region and of the sealing region are equal, and, further preferably, the guide region and the sealing region are produced from the same materials.

A particularly high degree of tightness can be achieved if a thickness of the sealing region is approximately one-third of a thickness of the valve seat. The thickness of the sealing region and of the valve seat are determined perpendicular to the surface, starting from a sealing line between the closing element and the sealing region.

Further preferably, a material of the sealing region and a material of the closing element and/or a material of the sealing region and a material of the valve seat region are selected such that these materials are provided in powder form (in particular as feedstock) after shaping, e.g. by powder injection molding, and are subjected to a heat treatment at the same temperature, in this way yielding the differences in hardness of the sealing region and closing element, and/or of the sealing region and a valve seat region.

Particularly preferably, the valve according to the present invention is a magnetic valve for controlling fuel during fuel injection. Here, the magnetic valve according to the present invention can be fashioned as an intake manifold injection valve or as a direct injection valve.

Further preferably, the valve seat has a multiplicity of injection holes that, through the present invention, can be situated on an injection hole diameter that is significantly smaller than an injection hole diameter known in the existing art.

In the following, preferred exemplary embodiments of the present invention are described in detail with reference to the accompanying drawing. In the exemplary embodiments, identical or functionally identical components are designated with the same reference characters.

DETAILED DESCRIPTION OF THE INVENTION

In the following, an injection valve 1 according to a first preferred exemplary embodiment of the present invention is described in detail, with reference to FIGS. 1 through 3.

Figure 1:
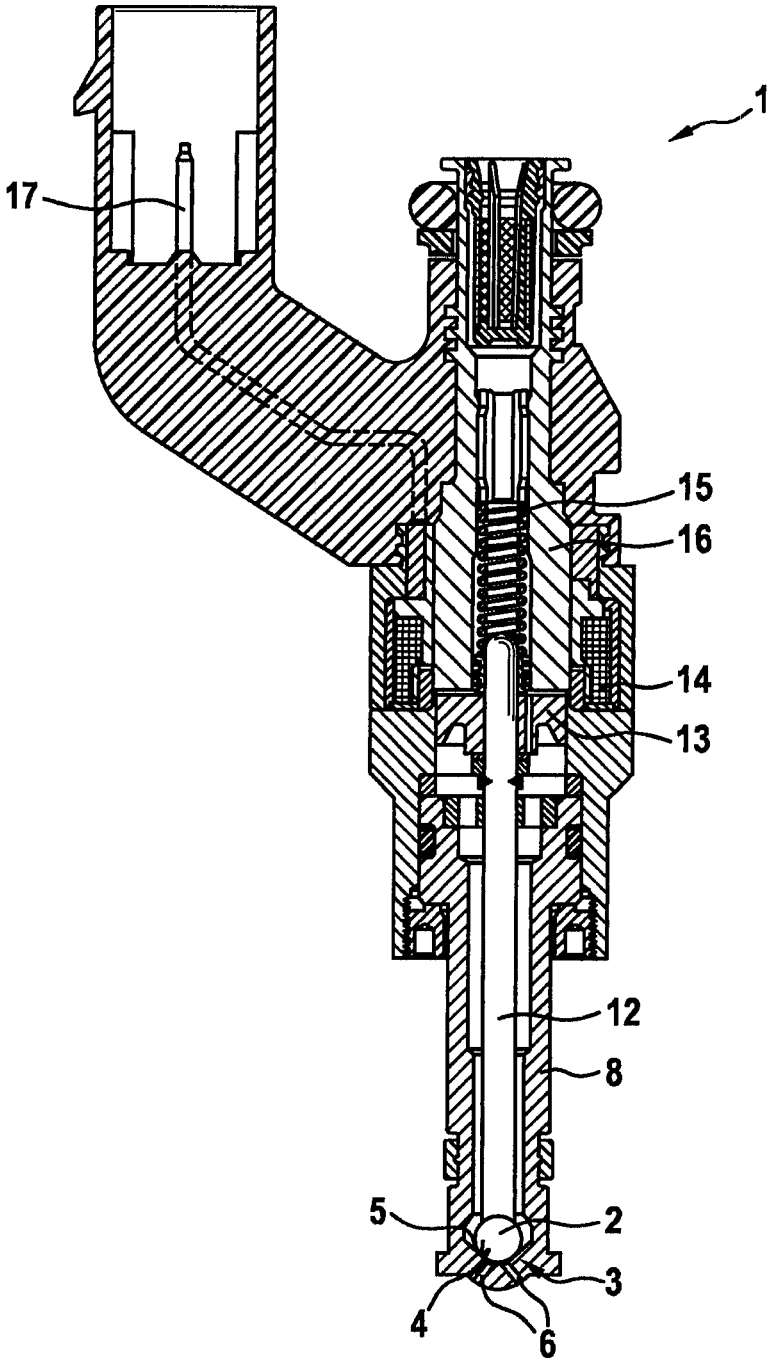
FIG. 1 shows a schematic view of an injection valve according to a first exemplary embodiment of the present invention.

As can be seen from FIG. 1, injection valve 1 has a valve housing 8, a magnetic armature 13, a coil 14, and an inner pole 16. A closing spring 15 is provided in order to close the injection valve after the injection has taken place. Reference character 17 designates an electrical terminal.

In this exemplary embodiment, a closing element 2 in the form of a ball is provided, the ball being in connection with a valve needle 12 on which magnetic armature 13 is situated.

Figure 2:
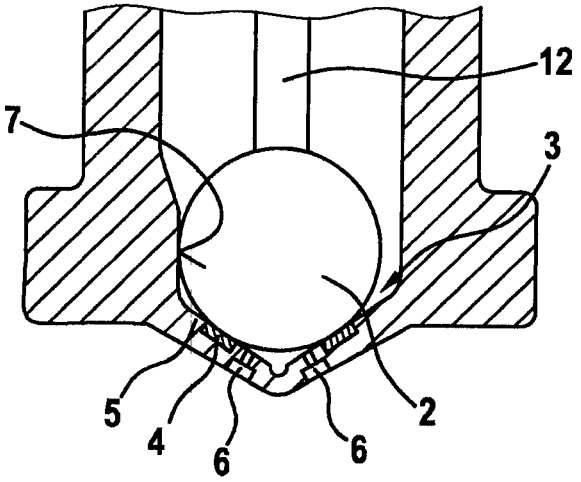
FIG. 2 shows a schematic sectional view of a valve seat of the injection valve of FIG. 1.
Figure 3:
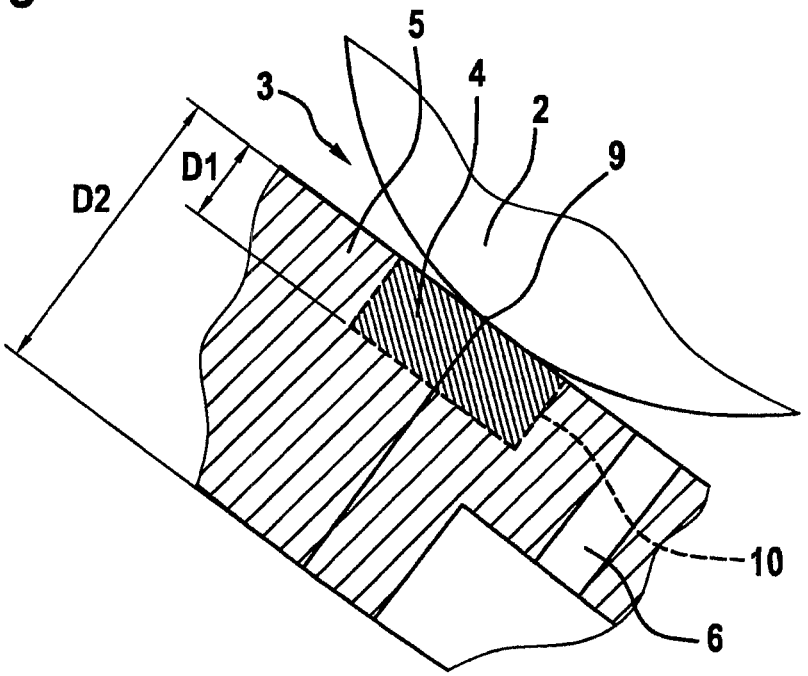
FIG. 3 shows an enlarged schematic partial view of the valve seat of FIG. 2.

Closing element 2 here seals on a valve seat 3, as is shown in detail in FIGS. 2 and 3. In this exemplary embodiment, valve seat 3 is made spherical.

As can be seen in particular in FIG. 3, valve seat 3 has a sealing region 4 and a valve seat region 5 adjoining sealing region 4. Sealing region 4 is fashioned with an annular shape on valve seat 3, and has a rectangular cross-section (cf. FIG. 3). Valve seat 5 is provided at both sides of sealing region 4.

In addition, on the valve seat there is fashioned a plurality of injection holes 6 via which fuel can be injected into a combustion chamber or the like. In this exemplary embodiment, injection holes 6 are made in stepped fashion.

As can also be seen in FIG. 2, a guide region 7 is provided by which closing element 2 is guided. This achieves a fast and secure closing of the valve.

FIGS. 1 through 3 each show the closed state of the valve. As can be seen in FIG. 3, a linear sealing line 9 is then formed between closing element 2 and sealing region 4 of valve seat 3.

According to the present invention, a hardness of closing element 2 is selected such that closing element 2 has a greater hardness than sealing region 4. In addition, valve seat region 5, which directly adjoins sealing region 4, has a greater hardness than does sealing region 4. Here, the hardness of valve seat region 5 is less than the hardness of closing element 2. The hardness of closing element 2, of sealing region 4, and of valve seat region 5 can be determined using known methods (e.g. the Vickers test).

Valve seat 3 of the first exemplary embodiment is produced using the MIM technique, different materials being used for sealing region 4 and for valve seat region 5. This results in a material bond 10 between sealing region 4 and valve seat region 5, indicated in FIG. 3 by the dashed line.

In FIG. 3, it can also be seen that a thickness D1 of sealing region 4, perpendicular to the surface of the valve seat, is approximately one-third of an overall thickness D2 of valve seat 3. In addition, there is no step present between sealing region 4 and valve seat region 5, so that the sealing region and the valve seat region merge with one another directly and continuously.

Through the selection according to the present invention of the different hardnesses between closing element 2 and sealing region 4, an improved tightness of the valve in the closed state is possible. Here, in particular impact impulses that occur due to a closing process of the valve are absorbed, and a noise level is also reduced. Here as well, no plastic deformation occurs between closing element 2 and sealing region 4, so that the tightness at sealing line 9 can be maintained over a long operating duration of the valve. It is possible that a slight elastic deformation may occur at sealing region 4, but this deformation is reversed when closing element 2 lifts away. The present invention can also result in reduced wear, so that a defined optimal surface condition at sealing region 4 can be maintained longer.

In addition, the use of the MIM method can ensure a particularly low-cost production of valve seat 3 according to the present invention. According to the present invention, component loading is also reduced, so that injection holes 6 can be configured closer to one another, and in particular a seat diameter of injection holes 6 can be made smaller. This results in the further advantage that smaller magnetic forces are required for the opening, so that the magnetic circuit can be designed at lower cost, and in particular a power requirement of the magnetic circuit for opening is also reduced.

Thus, according to the present invention, through the selection of different hardnesses of sub-regions at valve seat 3 an improved tightness of the valve in the closed state can surprisingly be achieved. In addition, a certain degree of damping during the closing process, and reduced wear, are also obtained.

Figure 4:
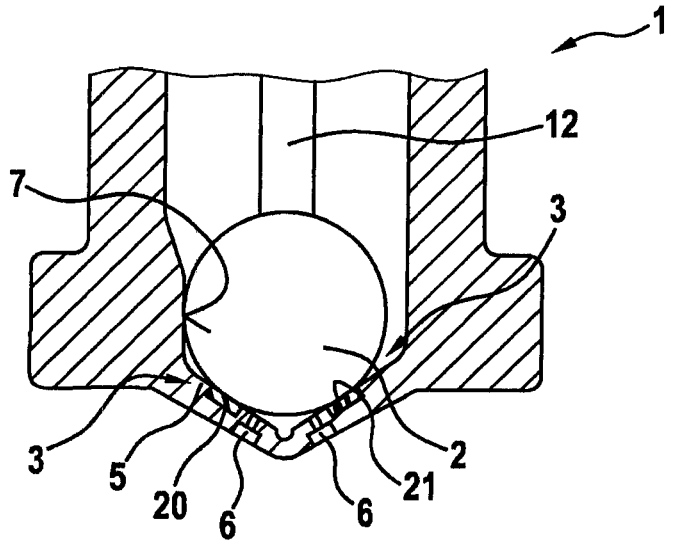
FIG. 4 shows a schematic sectional view of a valve seat according to a second exemplary embodiment of the present invention.

FIG. 4 shows a valve 1 according to a second preferred exemplary embodiment of the present invention. In valve 1 of the second exemplary embodiment, the sealing region of the valve is formed by an elastomeric sealing element 20. As can be seen in FIG. 4, sealing element 20 has a rectangular cross-section and is situated in a groove 21 in valve seat 3. Thus, the sealing region is situated in valve seat 3 with a positive fit. Here, at the side oriented towards closing element 2, an interruption-free transition is present between sealing region 4 and valve seat region 5.

Figure 5:
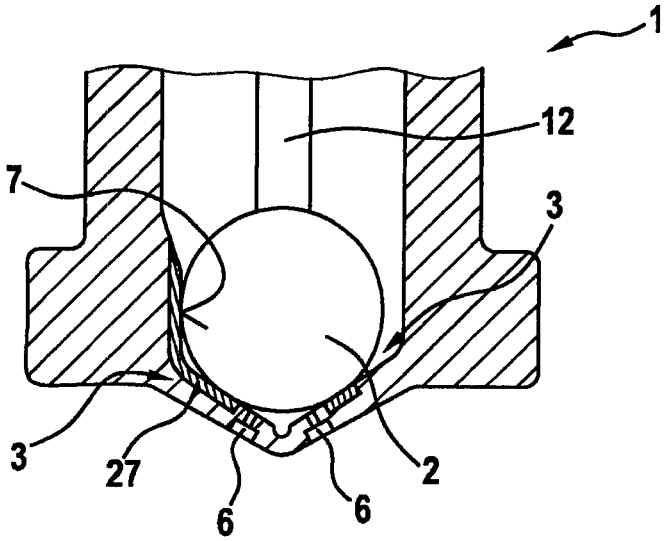
FIG. 5 shows a schematic sectional view of a valve seat according to a third exemplary embodiment of the present invention.

FIG. 5 shows a valve 1 according to a third exemplary embodiment of the present invention. The third exemplary embodiment differs from the first exemplary embodiment in that a guide region 27 is directly adjacent to sealing region 4. Guide region 27 also has a different hardness than a hardness of closing element 2. Particularly preferably, a hardness of guide region 27 and of sealing region 4 are equal. Sealing region 4 and guide region 27 can also be produced in one step, together with valve seat 3, using an MIM method. Here it is also possible for a different metal powder to be used for guide region 27, so that in the finished component sealing region 4 and guide region 27 then have different hardnesses. A thickness of sealing region 4 and of guide region 27 is preferably equal.

What is claimed is:

1. A valve for controlling a fluid, comprising:

a closing element;

a valve seat having a sealing region and a valve seat region adjoining the sealing region; and a guide region for guiding the closing element;

wherein the guide region has a hardness less than the hardness of the closing element;

wherein the guide region has a hardness greater than the hardness of the sealing region;

wherein the closing element seals on the sealing region at an inner surface of the sealing region;

wherein the sealing region and the valve seat region merging with one another directly and without a step at an outer surface of the sealing region;

wherein a hardness of the sealing region is less than a hardness of the closing element;

wherein the sealing region is configured as an annular elastomeric sealing element situated in a groove in the valve seat; and wherein the annular elastomeric sealing element has a rectangular cross-section, the cross-section being formed by a plane orthogonal to the inner surface and outer surface of the sealing region.

2. The valve as recited in claim 1, wherein the difference in hardness between the sealing region and the closing element is selected such that the closing of the valve takes place without plastic deformation at the sealing region.

3. The valve as recited in claim 2, wherein in the closed state of the valve a sealing line is formed between the sealing region and the closing element.

4. The valve as recited in claim 2, wherein the valve seat region has a hardness which is at least one of (i) greater than the hardness of the sealing region and (ii) less than the hardness of the closing element.

5. The valve as recited in claim 2, wherein the valve is a magnetic valve.

6. A valve for controlling a fluid, comprising:

a closing element;

a valve seat having a sealing region and a valve seat region adjoining the sealing region; and a guide region for guiding the closing element;

wherein the guide region has a hardness less than the hardness of the closing element;

wherein the guide region has a hardness greater than the hardness of the sealing region;

wherein the closing element seals on the sealing region at an inner surface of the sealing region;

wherein the sealing region and the valve seat region merging with one another directly and without a step at an outer surface of the sealing region;

wherein a hardness of the sealing region is less than a hardness of the closing element, wherein a thickness of the sealing region is approximately one-third of a thickness of the valve seat at the sealing region;

wherein the sealing region is configured as an annular elastomeric sealing element situated in a groove in the valve seat, and wherein the annular elastomeric sealing element has a rectangular cross-section, the cross-section being formed by a plane orthogonal to the inner surface and outer surface of the sealing region.

* * * * *